US005902217A

United States Patent [19]

Schechner et al.

[11] Patent Number: 5,902,217

[45] Date of Patent: May 11, 1999

[54] MARTIAL ARTS AND BOXING ACCESSORY APPARATUS FOR HEAVY BAG

[76] Inventors: Matthew S Schechner, 11105 N 115 th. St. # 1019, Scottsdale, Ariz. 85259; Allen T Adams, 160 W. Ivyglen St., Mesa, Ariz. 85201-2200

[21] Appl. No.: 08/936,215

[22] Filed: Sep. 24, 1997

[51] Int. Cl.[6] ..... A63B 69/00

[52] U.S. Cl. ..... 482/83; 482/87; 482/90

[58] Field of Search ..... 482/139, 38–41, 482/89, 126, 83

[56] References Cited

U.S. PATENT DOCUMENTS

| | | | |
|---|---|---|---|
| 4,434,980 | 3/1984 | Babineaux | 482/89 |
| 4,949,956 | 8/1990 | Pobran | 482/38 |
| 5,281,191 | 1/1994 | DeSousa | 482/87 |
| 5,453,067 | 9/1995 | Cianfrocca, II | 482/139 |
| 5,697,872 | 12/1997 | Stronsick, Jr. et al. | 482/87 |
| 5,788,613 | 8/1998 | Grimald | 482/87 |
| 5,800,319 | 9/1998 | Choate | 482/87 |

*Primary Examiner*—Jerome Donnelly
*Attorney, Agent, or Firm*—Terry L. Miller

[57] ABSTRACT

A device for physical training, such as in martial arts, boxing and similar disciplines that involve punching, kicking, wing chun kung fu drills, etc. These training and drills are performed without the need for a partner by the use of a training accessory that mounts to a heavy training bag and which provides targets or wing chun type blocking arms which the trainee can punch, kick, or block, for example. The training accessory has a frame that mounts to the heavy bag by use of cinch straps, and includes a pair of depending bars positioned one on each side of the bag. Accessory arms selectively mount to the depending bars and carry or define punching, kicking, or striking targets or wing chun blocking arms. Straps are secured to the heavy bag to prevent its twisting undesirably in response to torque generated by impacts and blocking movements of the trainee.

6 Claims, 5 Drawing Sheets

MARTIAL ARTS AND BOXING ACCESSORY APPARATUS FOR HEAVY BAG

BACKGROUND OF THE INVENTION

1. Field of the Invention

This invention is directed to provide a training aid, which is used while mounted on a heavy bag for practicing martial arts and boxing techniques. The training aid utilizes a frame carried on the heavy bag and various targets, mounted to this frame. A martial artist or boxing trainee, for example, thus can train without the necessity for a partner.

2. Related Technology

An extremely popular method of martial arts and boxing training involves having a partner hold a pair of focus mitt gloves at various levels which the trainee strikes as a target. The mitts fit over the partner's hands like a glove with a padded front surface covered with vinyl for striking by the trainee without injuring the partner's hands. The major limitation of this method is the necessity for a training partner. Effective training without a partner can often times be impractical or impossible. There are various products that provide targets to strike at for training purposes, but these all suffer from one or more deficiencies. This invention, however, incorporates the use of a heavy bag to eliminate the need for a training partner while also overcoming other deficiencies of the conventional technology. For example, for trainees of wing chun kung -fu a staple training aid is the use of a large, heavy, stationary, columnar device called a "wooden man", which provides three appendages for striking and blocking practice. This device is rather cumbersome and heavy and does not provide for a realistic and dynamic target. This wooden man is also not reasonably available, or easily relocated.

SUMMARY OF THE INVENTION

Accordingly, an object of our invention is to remove the necessity for a training partner, allowing a person to train while incorporating the dynamic forces of a training partner. This would also enable a person to train without the aid of a heavy, cumbersome device such as the "wooden man".

Another object is to achieve a reduction in the cost of such a device.

It is thus another object and advantage for this invention to incorporate in the apparatus an anti-rotational feature, which allows use of the heavy training bag as a base of support without the obvious rotational force resulting from strikes by a trainee causing substantial rotation problems with the heavy training bag.

It is another object and advantage of this invention that the practitioner can switch from traditional martial arts and boxing training, such as punching and/or kicking the focus mitt targets to wing chun kung-fu training . This can be achieved simply by switching from the boxing and martial arts type of focus glove attachments to the wing chun type arm attachments without removing the frame, of the training aid from the heavy bag.

Still further objects and advantages will become apparent from a consideration of the ensuing description and accompanying drawings.

BRIEF DESCRIPTIONS OF THE DRAWINGS

DETAILED DESCRIPTION OF THE PREFERRED EXEMPLARY EMBODIMENTS

Figure 1:
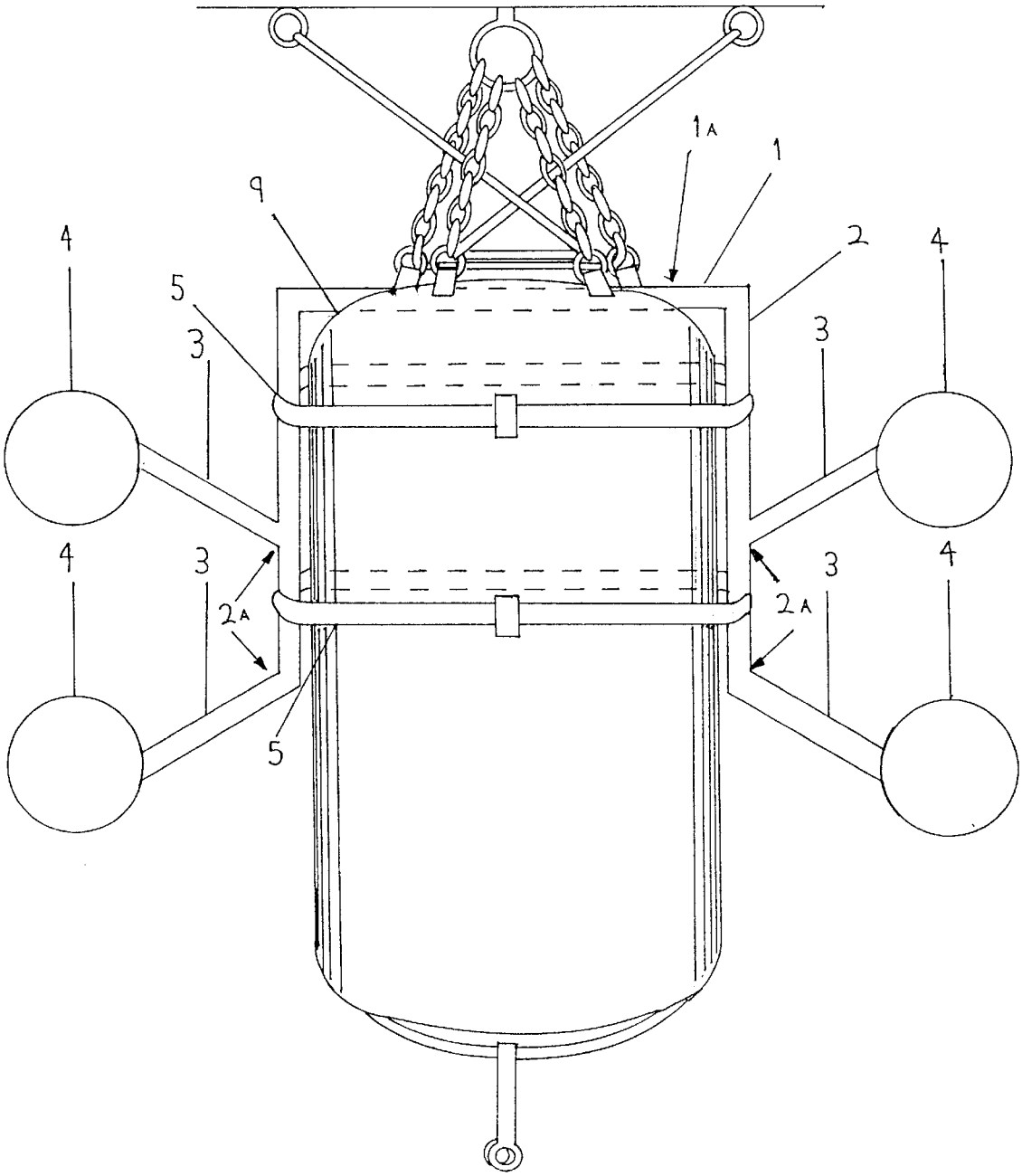
FIG. 1 is a frontal view of the accessory kit which includes the focus mitt target attachments, cinch straps, and de-rotational force straps all mounted to a conventional heavy bag.

Referring to FIG. 1, a conventional heavy bag 9 is supported by chains 8 from an overhead ceiling or beam (not shown). One conventional way of suspending such a heavy training bag is by the use of an eyebolt, the depending eye of which is depicted at the top of FIG. 1 immediately above and centered over the bag 9. At least two additional eyebolts, each having a respective eye spaced apart from the central supporting eye bolt are also provided, as is depicted in FIG. 1. The heavy bag 9 carries a frame 1*a,* which will be described in greater detail below. The frame 1*a* can be described as, for example, and without limitation, a horizontal bar 1*a* of PVC pipe or other appropriate material. Attached to each opposite end of the horizontal bar 1*a* is a respective one of two descending vertical bars 2 that each incorporate various coupling devices (indicated with arrowed numeral 2*a*); so that accessory arms 3 may be attached in multiple variations as demonstrated in FIGS. 1,2,3, and 4.

If the frame 1 is formed of PVC pipe, then the coupling devices 2*a* might be formed of pipe couplings (not shown). The accessory arms 3 extend from the frame 1 at varying and adjustable angles and at different heights along the vertical bars 2. Different types of targets may be used at the end of each arm 3. Focus mitt type targets 4 are demonstrated on the end of these arms 3 in FIGS. 1 and 2. Wing Chun arms 6 are demonstrated in FIGS. 3 and 4. In the case of the wing chun arms 6, they do not provide a separate target on their ends, but function as the targets themselves.

Figure 2:
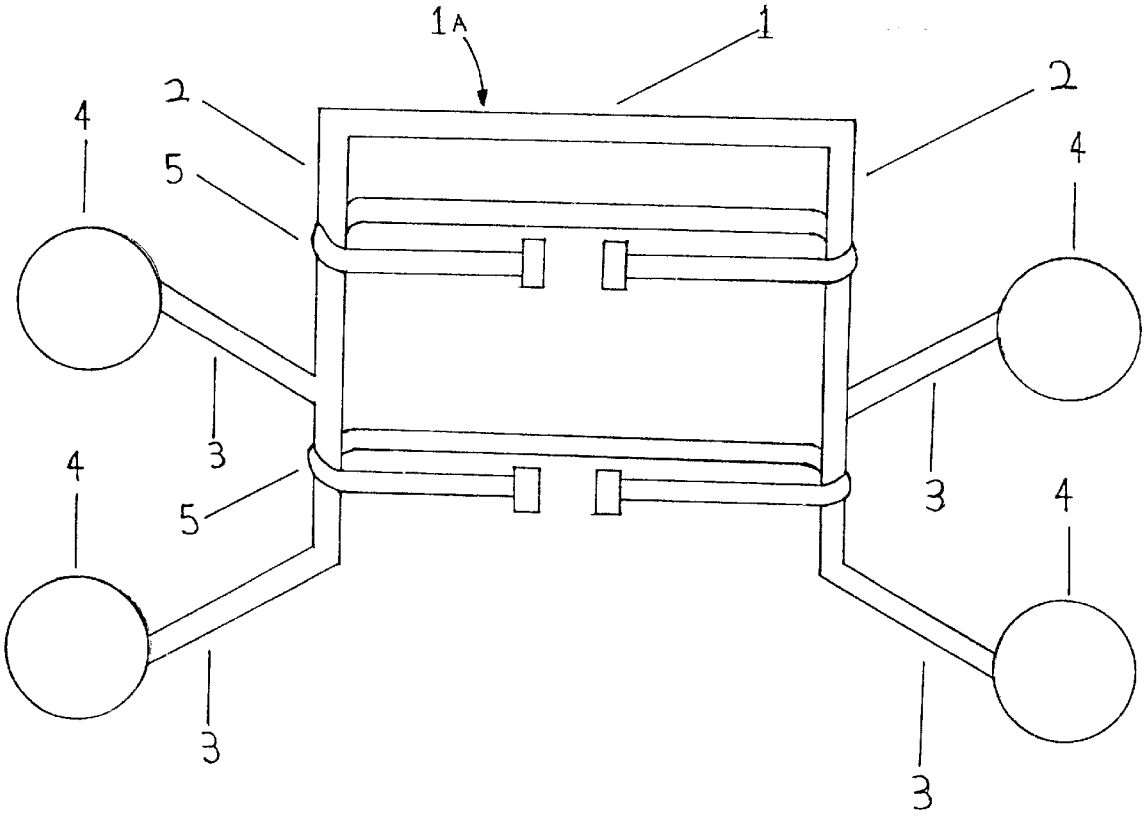
FIG. 2 is a front view of the accessory kit which includes the frame and focus mitt attachments, and straps for attachment to a heavy bag.
Figure 3:
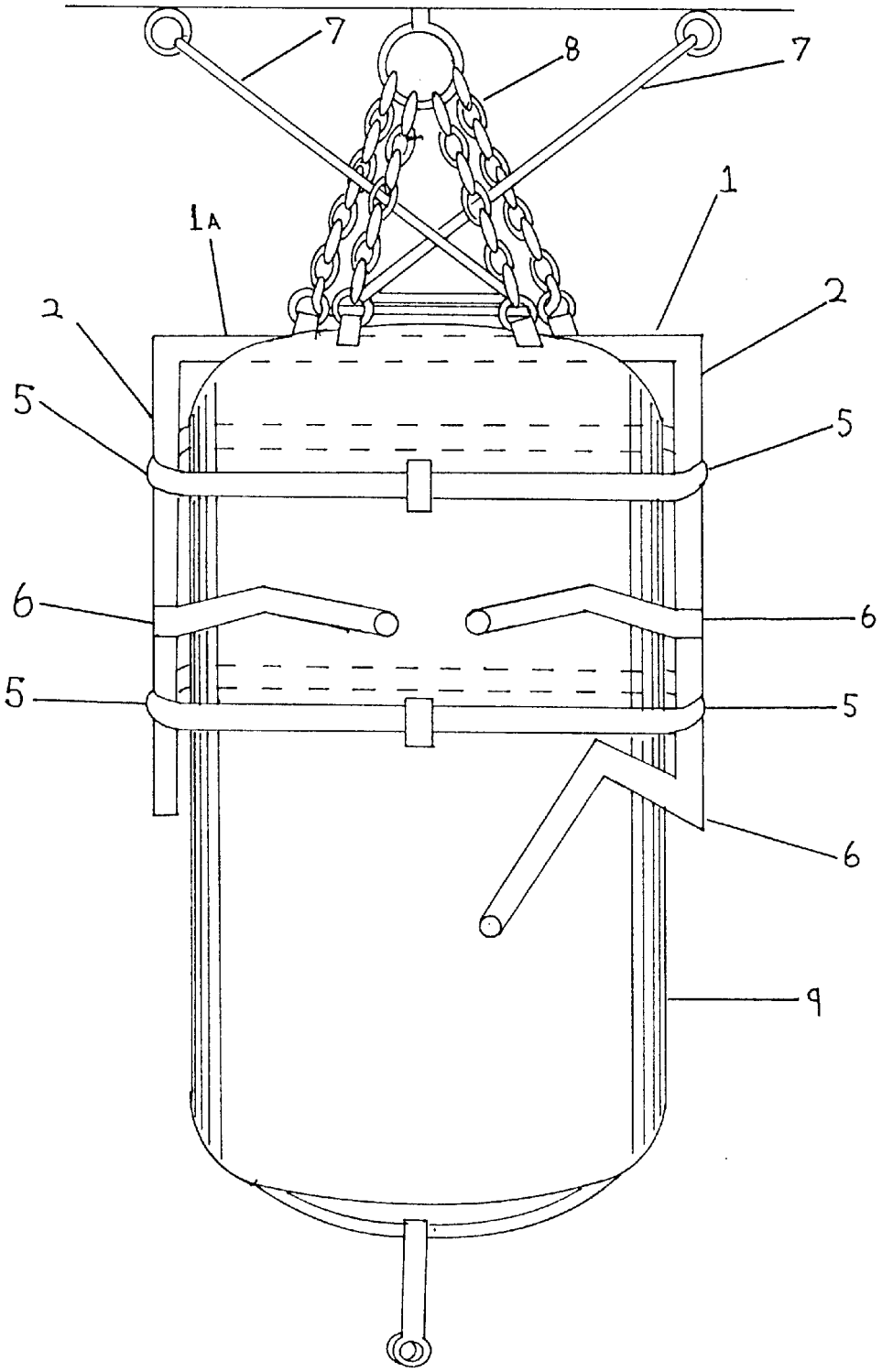
FIG. 3 is a frontal view of the frame with wing chun kung-fu type attachments, which includes: the frame, wing chun kung-fu attachments, cinch straps, and de-rotational straps with the heavy bag.

FIGS. 1, 2, 3, and, 4, in conjunction, demonstrates the two cinch straps 5 which attach to the two vertical bars 2 and wrap around the heavy bag 9 for securing the frame 1 to the heavy bag 9.

Figure 5:
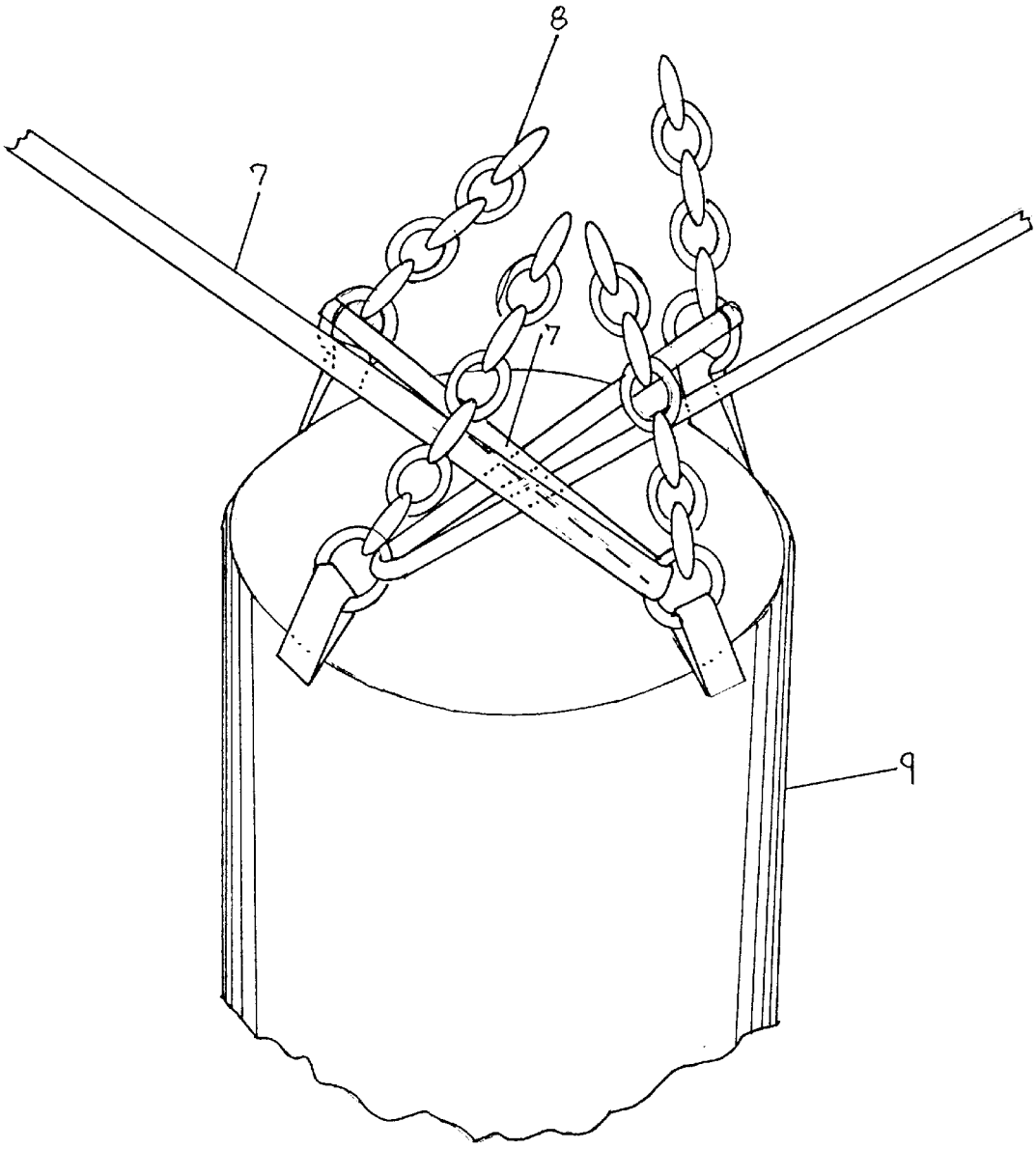
FIG. 5 is a top view with de-rotational force straps attached to the heavy bag.

FIG. 5 illustrates the two de-rotational straps 7 designed to prevent undue rotation of the target arms 3 when, the latter are struck by a trainee. The straps 7 attach to one of the four chains 8 holding the heavy bag 9 and are threaded through the supporting structure for the bag 9 in such a way as to counteract the rotational force when one side or the other of the target is struck. As is seen in FIGS. 1 and 3, the straps 7 extend angularly and secure to over head support (depicted as eyebolt eyes, which are not referenced in these Figures) which are spaced radially apart (i.e., in plan view) so as to employ the weight of the heavy bag 9 and the training apparatus to resist and counteract striking torque applied by the trainee. These straps 7 are adjustable in length so that the frame 1 can be lowered or raised to accommodate the trainee. These straps 7 may be attached to the supporting structure on which the bag 9 is hanging by various methods of fasteners, such as eyebolts having eyes as described above and as depicted diagrammatically in FIGS. 1 and 3.

Figure 4:
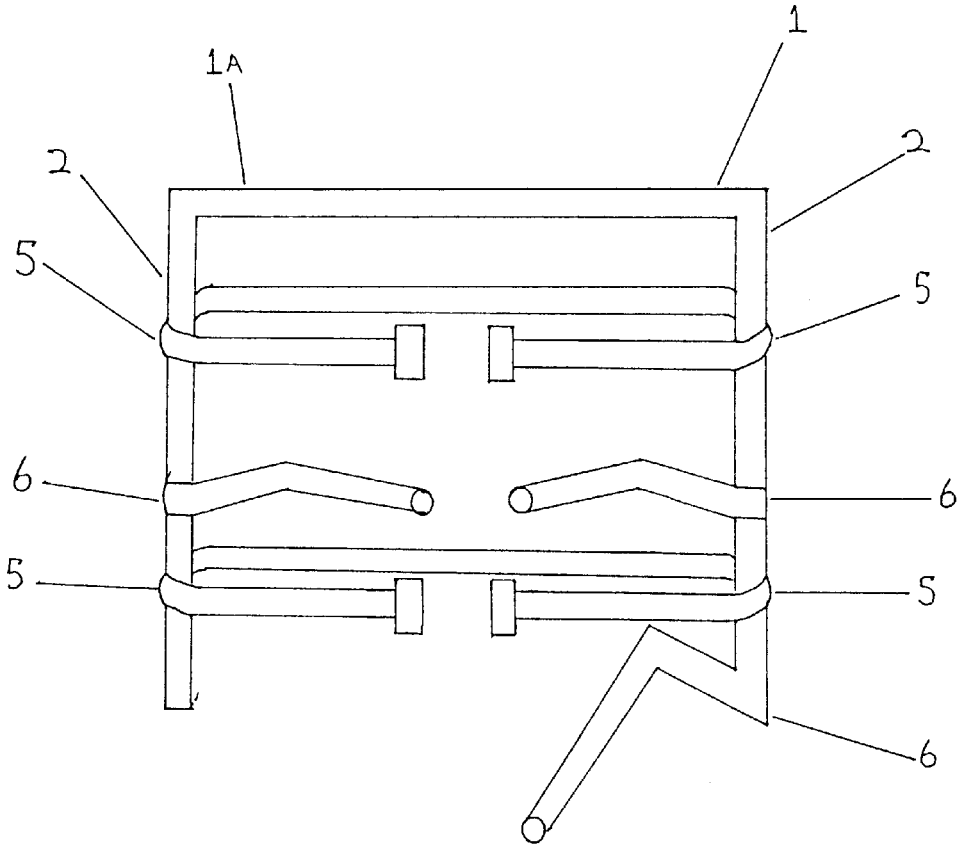
FIG. 4 is a frontal view with frame and wing chun type attachments, with cinch straps for attachment to a heavy bag.

Installation and use of the embodiment of the invention seen in FIGS. 1 and 4 is as follows. The trainee would attach the frame 1 as shown in FIGS. 1, 2, 3 and 4 to the conventional heavy training bag 9. The frame 1 would secure to the heavy bag 9 via the two cinch straps 5 shown in FIGS. 1, 2, 3, and 4 by wrapping these straps around the heavy bag 9 and securing by various securing devices, such as by use of buckles or cinch rings. The frame 1 is held in a stable position so that the trainee could strike targets at the ends of the accessory arms 3 seen in FIGS. 1, 2, 3, and 4. The accessory arms 3 project out from the bag 9 to allow room for the trainee to strike at them.

The trainee has choices of which accessory arms to employ. FIGS. 1 and 2 display focus mitt type targets 4 for martial arts and/or boxing training, e.g., punching and kicking practice. The trainee can remove the accessory arms and replace them easily with the wing chun accessory arms 6 pictured in FIGS. 3 and 4. The trainee could then perform traditional wing chun training or any other chosen use with the frame 1 secure to the bag 9 as with the focus mitt type target 4 mentioned previously.

The de-rotational straps 7 diagrammed in FIGS. 2, 4, and 5 prevent undue rotational momentum from occurring from the trainee striking at targets, due to their position on the chains 8 from which the bag 9 is mounted overhead. The de-rotational straps 7 are also adjustable in length allowing the trainee to raise or lower the frame 1 to accommodate differences in height or desires of the trainee for different target height.

Accordingly, it can be seen that the present invention as presented in the preferred exemplary embodiments, provides a simple and efficient method of training by enabling a trainee to strike at focus mitt type targets such the type many martial artists and boxers employ, without the necessity for a training partner to hold said target. With a quick change the unit can provide wing chun type training without the need for a large wooden man device or other substitute. Although the description above contains many specifics, these should not be construed as limiting the scope of the invention but as merely providing illustrations of some of the presently preferred embodiments of this invention. Various other embodiments and ramifications are possible within it's scope. For example, the frame could be of any shape or design that could still be secured to a heavy bag. The accessory arms could descend from the frame at any angle that would still allow the target to be stuck. The focus mitt targets could be noncircular, or the frame and accessory arms could be made of materials other than PVC piping. The number of targets projecting from the frame and accessory arms could be of a different than that displayed or of different size proportion relative to the size of the heavy bag. Thus the scope of the invention should be determined by the appended claims giving full cognizance to equivalents in all respects, rather than only by the examples given.

What is claimed is:

1. A training accessory apparatus especially adapted for use in association with and while mounted adjustably and removably to a generally cylindrical and vertically elongate suspended heavy training bag having a height, a top and a bottom, said training accessory apparatus comprising:

a frame of generally inverted U-shape, said frame having an elongated center bar which when said training apparatus is mounted to the heavy training bag extends generally horizontal across and adjacent to the top of the training bag;

said frame also including a pair of spaced apart legs extending generally parallel with one another from respective opposite end portions of said center bar; each depending leg when said training accessory apparatus is mounted to the training bag depending from adjacent the top end of the bag along opposite sides thereof to terminate at respective ends spaced below the top of the training bag and above the bottom of the training bag;

an arm attaching to one of said legs to extend outwardly of said training bag; strap means circumscribing both said pair of legs and said training bag for when tightened mounting said frame and arm removably and non-rotationally to the training bag.

2. The training accessory apparatus of claim 1 wherein each depending leg provides at least one coupling device along a respective side of the training bag.

3. The training accessory apparatus of claim 2 wherein each leg provides plural coupling devices spaced vertically apart along the height of the training bag.

4. The training accessory apparatus of claim 2 wherein said arm has a generally circular focus pad carried generally at an outer end of said arm.

5. The training accessory apparatus of claim 2 wherein said arm extends generally forwardly and generally perpendicularly to the plane of said U-shaped frame in plan view toward a one side of the training bag opposite to said frame, said arm including a generally horizontally extending padded distal end portion; whereby a pair of said such arms each attached to a respective one of said pair of legs converge at their distal end portions toward one another in plan view on said one side of the training bag, and in elevation view said arms each present to the trainee a respective cylindrical blocking extension outwardly of the heavy training bag and converging toward the trainee.

6. The training accessory apparatus of claim 2 further including a pair of derotational straps each extending from a respective one of a pair of spaced apart lower attachments at the top of said heavy training bag, and angularly upwardly to a respective point of securement which is generally coextensive in height with and spaced apart from a point of support for the heavy training bag, whereby said pair of angular de-rotational straps employ the weight of the heavy training bag to resist torque applied to the training accessory apparatus and training bag by a trainee so as to minimize responsive twisting of the training bag and training accessory apparatus.

* * * * *